United States Patent [19]

Nakahama

[11] Patent Number: 4,521,202

[45] Date of Patent: Jun. 4, 1985

[54] TILT LOCKING SYSTEM FOR SHIP PROPELLERS

[75] Inventor: Ryoji Nakahama, Iwata, Japan

[73] Assignees: Yamaha Hatsudoki Kabushiki Kaisha; Sanshin Kogyo Kabushiki Kaisha, both of Japan

[21] Appl. No.: 481,315

[22] Filed: Apr. 1, 1983

[30] Foreign Application Priority Data

Apr. 26, 1982 [JP] Japan ..... 57-68750

[51] Int. Cl.[3] ..... B63H 5/12

[52] U.S. Cl. ..... 440/61; 440/56; 440/53; 440/55; 440/65; 188/318

[58] Field of Search ..... 440/56, 53, 61, 55, 440/62, 65; 188/318, 316, 313, 317, 319, 299; 267/127

[56] References Cited

U.S. PATENT DOCUMENTS

| | | | |
|---|---|---|---|
| 1,527,592 | 2/1925 | Livezey | 188/299 |
| 1,570,279 | 1/1926 | Pico | 188/299 |
| 2,363,867 | 11/1944 | Isely | 188/318 |
| 3,722,920 | 3/1973 | Reese | 188/318 |
| 3,799,104 | 3/1974 | Kurling | 440/61 |
| 3,972,396 | 8/1976 | Bochnak | 188/318 |
| 3,983,835 | 10/1976 | Hall | 440/61 |
| 4,084,668 | 4/1978 | Rybicki | 188/318 |

*Primary Examiner*—Trygve M. Blix
*Assistant Examiner*—C. T. Bartz
*Attorney, Agent, or Firm*—Ernest A. Beutler

[57] ABSTRACT

A tilt locking and shock absorbing arrangement for a marine outboard drive that normally holds the drive in a normal position against driving thrust both in forward and rearward directions and yet which permits the drive to pop up when an underwater obstacle is struck. The arrangement also permits the drive to return to its normal position once the obstacle has been passed. An arrangement is provided for permitting the motor to be tilted up without restriction and also to be adjusted in trim condition and retained there while still maintaining the aforenoted shock absorbing capabilities.

14 Claims, 8 Drawing Figures

TILT LOCKING SYSTEM FOR SHIP PROPELLERS

BACKGROUND OF THE INVENTION

This invention relates to a tilt locking system for ship propellers and more particularly to an improved arrangement for controlling the tilting movement of a marine outboard drive.

As is well known, it is the normal practice to mount a marine outboard drive for pivotal movement about a horizontally disposed tilt axis so that the propeller can be tilted up out of the water when not in use. The term "marine outboard drive" is used herein generically to cover both outboard motors and the outboard drive unit of a marine inboard/outboard drive. When the lower end of the outboard drive strikes an underwater obstacle, it is desirable to permit the motor to tilt or pop up so as to clear this obstacle. However, the tilting mechanism should insure that the outboard drive returns to its normal position once the obstacle is cleared and also that the outboard drive is held against such movement under normal acceleration and driving forces both in forward and reverse.

It has been proposed to employ a hydraulic cylinder assembly with appropriate valving and controls for achieving some of these results. Such an arrangement is shown in copending application Ser. No. 326,553, filed Dec. 2, 1981, now U.S. Pat. No. 4,493,659 entitled "Tilt Lock Mechanism", filed in the name of Takashi Iwashita, and assigned to the assignee of this application. In that application, several embodiments of tilt locking systems for outboard drives are shown. In each embodiment, a hydraulic piston and cylinder assembly is interposed between the drive member of the outboard drive and the hull to which the outboard drive is pivotally attached. The piston divides the cylinder into first and second chambers and flow between these chambers is permitted by valved passages so that the motor may tilt up when striking an obstacle and will return to its normal state once the obstacle is passed. Tilting up action when an underwater obstruction is encountered is accomplished by means of a passage that permits flow between the respective chambers of the hydraulic unit and which includes a pressure responsive absorber valve to permit the outboard drive to tilt up when a predetermined force is exerted to it. The outboard drive is permitted to move downwardly by means of a second passage that includes a pressure responsive relief valve for permitting the flow back from the one chamber to the other when the obstacle is no longer encountered.

In order to facilitate manual tilting up of the outboard drive, a bypass passage having a manually controlled valve is provided. This valve may be opened to permit free movement of the fluid between the two chambers to facilitate tilting up of the outboard drive.

In some instances, it is desirable to raise the engine only slightly so as to adjust its trim position. An example of when this is done is when operating in shallow water. Under these conditions, the outboard drive is operated at a shallower angle so as to prevent it from contacting the bottom. However, the weight of the motor will cause the relief valve will open when the motor is tilted up and permit the motor to swing back to its normal operating condition.

It is, therefore, a principal object of this invention to provide an improved tilt locking and shock absorbing arrangement for a marine outboard drive.

It is another object of the invention to provide a tilt locking and shock absorbing construction for a marine outboard drive that permits the motor to be tilted up without interference from the shock absorbing unit.

It is a further object of the invention to provide a tilt locking and shock absorbing arrangement for an outboard motor that permits the motor to be adjusted for trim without having the motor gradually returned to the normal condition.

SUMMARY OF THE INVENTION

A first feature of this invention is adapted to be embodied in a tilt locking and shock absorbing arrangement for a marine outboard drive that comprises a drive member supported for tilting movement relative to the hull of an associated watercraft about a substantially horizontally disposed tilt axis. A hydraulic assembly comprising a cylinder and a piston slidably supported in the cylinder and dividing the cylinder into first and second chambers is operatively interposed between the hull and the drive member for relative movement of the piston and cylinder upon tilting movement of the drive member about the tilt axis. First passage means including pressure responsive absorber valve means for permitting flow from the first chamber to the second chamber upon the application of a predetermined force tending to cause the drive member to tilt up about the tilt axis is provided. In addition, there are provided second passage means including pressure responsive relief valve means for permitting flow from the second chamber to the first chamber upon the exertion of a predetermined force to effect tilt down of the drive member. In accordance with this feature of the invention, means are provided for permitting the drive member to be tilted up about the tilt axis to a raised position and to be retained in the raised position. This last named means includes a third passage so that extends between the first and second chambers, and a first manually operated valve for controlling the flow through the third passage. A first check valve is positioned in the third passage for permitting flow from the first chamber to the second chamber when the first manually operated valve is opened and for precluding flow from the second chamber to the first chamber through the third passage.

Another feature of the invention is also adapted to be embodied in a tilt locking and shock absorbing arrangement for an outboard drive having a hydraulic cylinder and piston assembly interposed between the drive member and the hull and including first and second passages as set forth in the preceding paragraph. In accordance with this feature of the invention, means are provided for permitting popping up of the drive member about the tilt axis when the drive member strikes an obstacle. This popping up means includes a third passage that extends between the first chamber and the second chamber and which includes first check valve means for permitting flow from the first chamber to the second chamber. Second check valve means are provided downstream from the first check valve means and also permits flow from the first chamber to the second chamber. Time delay means are incorporated for opening the second check valve means upon opening of the first check valve means and for holding the second check valve means opened for a time after the first check valve means closes. Fourth passage means including third check valve means communicate a point in the third passage means between the first and second check valve means with the first chamber. The third check valve means precludes flow through the fourth passage means from the first chamber and permits flow through the fourth passage means to the first chamber.

A yet further feature of the invention is also adapted to be embodied in a tilt locking and shock absorbing arrangement for a marine outboard drive that includes a drive member that is supported for tilting movement relative to the hull of an associated watercraft and a hydraulic assembly comprising a cylinder and piston interposed between the drive member and the hull. The piston divides the cylinder into first and second chambers. Damping means permit flow from the first chamber to the second chamber upon the application of a predetermined force tending to cause the drive member to tilt up about the tilt axis and for permitting flow from the second chamber to the first chamber upon the exertion of a predetermined force to effect tilting down of the drive member. In accordance with this feature of the invention, means permit popping up of the drive member about the tilt axis when the drive member strikes an obstacle. This popping up means includes first passage means extending between the first chamber and the second chamber and including first check valve means for permitting flow from the first chamber to the second chamber. Second check valve means are interposed downstream of the first check valve means for permitting flow from the first chamber to the second chamber. Time delay means are incorporated for opening the second check valve means upon opening of the first check valve means and for holding the second check valve means open for a time after the first check valve means closes. Second passage means including third check valve means communicate a point in the third passage means between the first and second check valve means with the first chamber. The third check valve means precludes flow through the second passage means from the first chamber and permits flow through the second passage means to the first chamber.

BRIEF DESCRIPTION OF THE DRAWINGS

FIG. 3 shows the arrangement in the normal operating condition.

FIG. 4 shows the arrangement during pop up condition.

FIG. 5 shows the arrangement upon return to the normal condition after pop up.

FIG. 6 shows the condition when manual trim is achieved.

FIG. 7 shows the arrangement of popping up when the motor has been manually trimmed.

FIG. 8 is the return from the condition of FIG. 7.

DETAILED DESCRIPTION OF THE PREFERRED EMBODIMENT

Figure 1:
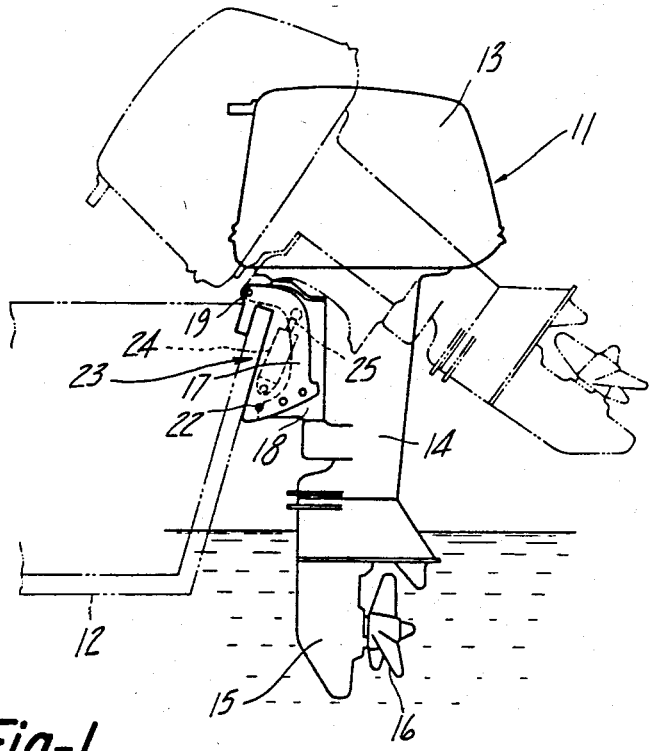
FIG. 1 is a side elevational view of an outboard motor attached to the transom of the hull of a boat and constructed in accordance with an embodiment of the invention. The motor is shown in its normal position in solid line views and in a tilted up position in broken lines.
Figure 2:
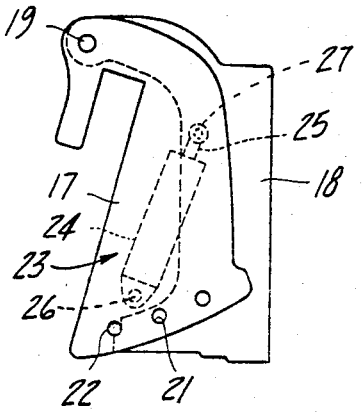
FIG. 2 is an enlarged side elevational view showing the mounting arrangement for the motor.

Referring first to FIGS. 1 and 2, an outboard motor constructed in accordance with this invention is identified generally by the reference numeral 11. The motor 11 is shown attached to the transom of a hull of a watercraft such as a motor boat, which hull is shown partially in phantom and is identified generally by the reference numeral 12. Although the invention is described in conjunction with an outboard motor, as aforenoted, it is equally applicable to the outboard drive of an inboard/-outboard arrangement.

The motor 11 includes a power head 13 consisting of an outer protective cowling and an internal combustion engine of any known type. A drive shaft housing 14 depends from the power head 13 and carries a lower unit 15 at its lower end. A propeller 16 is supported by the lower unit 15 and is driven in a known manner. Preferably, the lower unit 15 includes a forward/neutral/reverse transmission of a known type so that the propeller 16 may be held in a neutral condition, operated to drive the boat 12 forwardly or operated to drive the boat 12 in a rearward direction.

The arrangement for securing the motor 11 to the hull 12 includes a clamping bracket 17 that carries a clamping arrangement (not shown) of a known type for securing it to the transom 12. The clamping bracket 17 in turn pivotally supports a swivel bracket 18 by means of a pivot pin 19 for tilting movement about a substantially horizontally disposed tilt axis. The swivel bracket 18 in turn supports the drive shaft housing 14 for steering movement about a generally vertically extending steering axis in a known manner. The swivel bracket 18 and drive shaft housing 14 are, however, connected for simultaneous tilting movement about the tilt axis defined by the pivot pin 19.

A series of trim apertures 21 are formed in the clamping bracket 17 so as to selectively receive a trim adjusting pin 22. The swivel bracket 18 has a forwardly extending projection that engages the trim adjusting pin 22 so as to determine the trim angle at which the motor 11 operates. The aforedescribed construction is generally conventional and, for that reason, further details have not been given.

A tilt locking and shock absorbing assembly, indicated generally by the reference numeral 23 is provided for holding the motor 11 in an adjusted trim position relative to the hull of the watercraft 12, for permitting the motor 11 to pop up when an underwater obstacle is struck and for permitting the motor 11 to return to its preset trim position once the obstacle is passed. The assembly 23 is comprised of a double acting hydraulic cylinder and piston. As such, the assembly includes a cylinder 24 and piston (later to be numbered) to which a piston rod 25 is attached. As will become apparent in connection with the description of the remaining figures, the piston rod is affixed to a piston which is slidably supported in the cylinder.

The assembly 23 is attached to the motor 11 and hull 12 in such an arrangement that the piston and cylinder 24 will move relative to each other upon pivotal movement about the tilt axis 19. This may be accomplished in a variety of manners and in the illustrated embodiment, the lower end of the cylinder 24 is pivotally connected to the clamp bracket 17 by means of a pivot pin 26. In a similar manner, the upper end of the piston rod 25 is pivotally connected by means of a pivot pin 27 to the swivel bracket 18. Of course, the connections may be reversed or, as has been noted, the connections may be made to different elements of the assembly.

Referring now primarily to FIGS. 3 through 8, the interior construction of the assembly 23 and the associated valving and circuitry will now be described. The-cylinder 24 is formed with a cylinder bore in which a piston 28 is slidably supported. As aforenoted, the piston 28 is connected to the end of the piston rod 25. The piston 28 cooperates with the bore of the cylinder 24 to define first and second fluid cavities 29, 31, on opposite sides of the piston 28. As the piston 28 reciprocates within the cylinder bore, the respective volumes of the cavities 29 and 31 will change. An incompressible fluid such as a hydraulic oil fills the chamber 31 and partially fills the chamber 29. The remaining portion of the chamber 29 is charged with a gas under pressure, indicated generally by the reference numeral 32. This gas under pressure serves to make up for the change in volume caused by the piston rod 25 depending upon the position of the piston 28 in the cylinder, as is well known in this art.

A first passage 33 extends from the chamber 29 to the chamber 31. In the illustrated embodiment, the passage 33 is formed internally in the piston 28. A pressure responsive check valve, which functions as an absorber valve, indicated by the reference numeral 34, is interposed in the passage 33 so as to permit fluid to flow from the chamber 29 into the chamber 31 when the pressure in the chamber 29 exceeds that necessary to open the valve 34. Flow will occur through the passage 33 when a predetermined force is exerted upon the motor 11 causing it to tilt up about its pivot axis 19.

A second fluid passage 35 extends from the chamber 31 to the chamber 29. In the illustrated embodiment, the passage 35 extends through the piston 28 in parallel relationship to the passage 33. A pressure responsive check valve which functions as a relief valve and which is indicated by the reference numeral 36 is provided in the passage 35. When the pressure in the chamber 31 exceeds that pressure at which the check valve 36 will open, flow may occur from the passage 31 through the passage 35 to the chamber 29.

A first bypass passage 37, which may be formed externally of the cylinder 24, is provided for permitting flow to occur from the first chamber 29 to the second chamber 31. A normally closed check valve 38 is positioned in the first bypass passage 37 so as to permit flow from the chamber 29 to the chamber 31 while preventing flow in a reverse direction. A normally closed, manually operated valve 39 is positioned also in the bypass passage 37. The valve 39 is adapted to be operated by a mechanically operated knob 41 that can be actuated by the operator so as to move the valve 39 from its normally closed position (FIGS. 3–5) to an opened position (FIGS. 6–9).

A second bypass passage 42 extends between the chambers 29 and 31 and parallel to the bypass passage 37. The second bypass passage 42 is designed so as to permit flow from the chamber 31 to the chamber 39 and for that purpose has a check valve 45 positioned in it. A manually operated valve 44, which is normally open, is also positioned in the passage 42 in series relationship with the check valve 43. If desired, the manually operated valve 44 may be affixed for simultaneous operation with the manually operated valve 39 of the bypass passage 37 by the knob 41. When the valve 44 is in its opened position (FIGS. 3–5) and a pressure is exerted in the chamber 31 sufficient to open the check valve 43, flow may occur from the chamber 31 to the chamber 29 through the bypass passage 42.

A third bypass passage 45 extends in parallel to the bypass passages 37 and 42 between the chambers 29 and 31. The third bypass passage 45 includes a pressure responsive check valve 46 that is designed to permit flow from the chamber 29 when the pressure exceeds a predetermined value. The check valve 46 permits flow in the same direction as the absorber valve 34. The valve 46, however, is designed so as to open at a lower pressure than the pressure at which the absorber valve 34 opens.

A second check valve 47 is provided in the bypass passage 46 and functions, as will become apparent, so as to provide a return effect in addition to its normal check valve effect. The check valve 47 forms a portion of a return valve assembly, indicated by the reference numeral 48 and which includes a time delay actuating member 49. The actuating member 49 is comprises of a piston having a restricted orifice 51 extending through it. A rod 52 is affixed to the piston 49 and is adapted to engage the check valve 47 to open it for a purpose to be described.

A return passage 53 extends from a point in the return valve 48 between the check valve 47 and the check valve 46. The return passage 53 communicates with the return valve 48 between the piston 49 and the check valve 47. This area is communicated with the bypass passage 42 between the manually operated valve 44 and the check valve 43.

OPERATION

Figure 3:
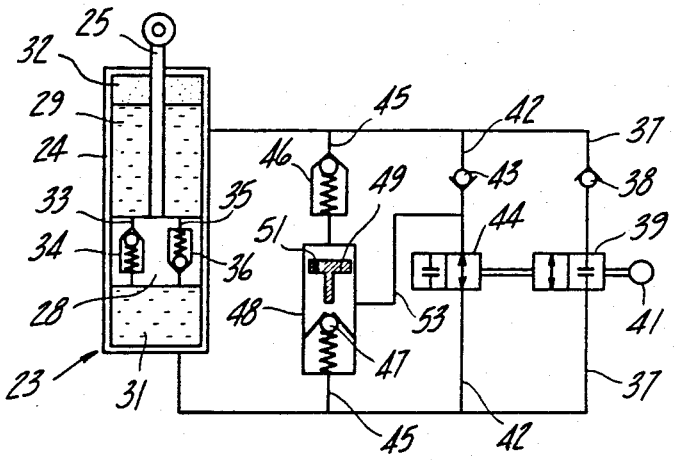
FIGS. 3 through 8 are partially schematic views showing the hydraulic tilt locking and shock absorbing arrangement in different modes of operation.
Figure 4:
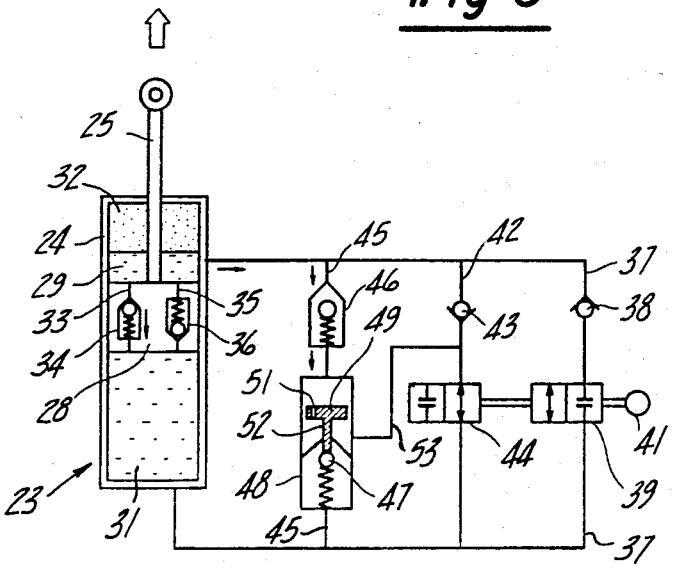

FIG. 3 illustrates the hydraulic circuitry in the normal running condition. In this condition, the piston 28 will be at a relatively low position in the cylinder 24 and the swivel bracket 18 will be engaged with the trim adjusting pin 22. Forward driving thrust of the propeller 16 will then be absorbed by this contact between the swivel bracket 18, the trim adjusting pin 22 and the clamping bracket 17.

If the lower unit 15 strikes a submerged article (FIG. 4) and there is sufficient force, the pressure in the chamber 29 will raise sufficient so that the check valve 46 and, if high enough, the check valve 34 will open. Flow from the chamber 29 to the chamber 31 will then be accomplished through opening of the check valve 46 and absorber valve 44. When the check valve 46 opens, pressure will be exerted on the head of the piston 49. This pressure will cause the piston 49 to move downwardly so that its rod 52 engages and opens the check valve 47. Therefore, there can be flow from the chamber 29 to the chamber 31 through the third bypass passage 45. In addition, as has been noted, the absorber valve 34 may also be opened so as to permit flow in the direction of the arrow shown in this figure.

Figure 5:
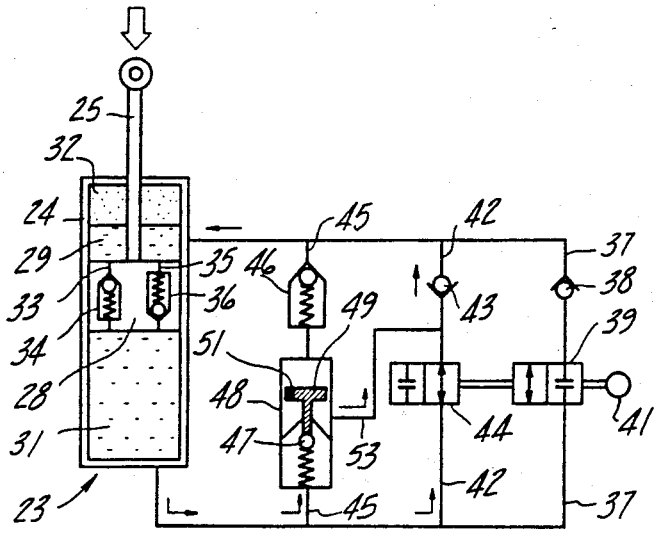

Once the motor 11 has popped up due to the aforenoted action and the obstacle has been cleared, the pressure in the chamber 29 will be reduced and the check valve 46 and absorber valve 34 will close (FIG. 5). However, the piston 49 will still be retained in a condition so as to hold the check valve 47 open for a period of time. The reason the check valve 47 is held open is that the orifice 51 in the piston 49 tends to resist movement of the check valve 47 to its closed position for a period of time. Thus, the weight of the motor 11 will exert a force through the piston rod 25 on the piston 28. Hence, the pressure in the chamber 31 will raise and fluid may flow from the chamber 31 through the bypass passage 45 and return passage 53 to effect opening of the check valve 43 in the bypass passage 42. This fluid can then be returned to the chamber 29. At the same time, the open valve member 44 permits flow directly from the chamber 31 to the chamber 29 past the check valve 43.

Considering again the normal running condition as shown in FIG. 3, the hydraulic arrangement 23 takes the reverse thrust so as to prevent popping up of the motor 11 now to be described. When the propeller 16 is operating so as to drive the watercraft 12 in a reverse direction, the pressure in the chamber 29 tends to rise. However, the check valves 46 and absorber valve 34 are set so as to require a greater than normal pressure to be exerted before these valves will open. Therefore, the hydraulic assembly 23 resists pivotal movement of the motor 11 when operating in a normal reverse mode. If, however, substantial forces in reverse are encountered due to rapid opening of the throttle of the motor 11, the mtor 11 may pop up in the same manner as if it had struck an obstacle when travelling forwardly. If the motor so pops up, it will rapidly return to its normal position once the forces are removed in the manner as aforedescribed.

Figure 6:
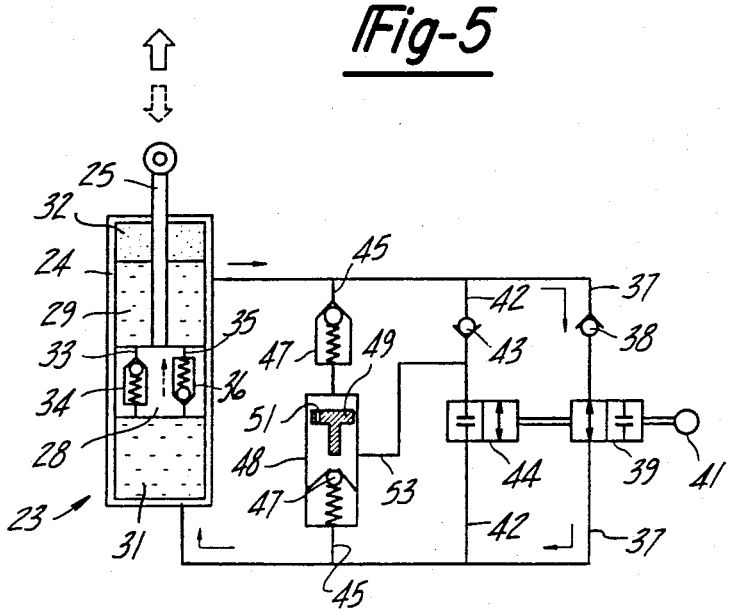

If the watercraft 12 encounters shallow water condition, it may be desirable to adjust the trim position of the motor 11 so that the propeller 16 and lower unit 15 are at a shallower depth in the water. This is accomplished by the operator grasping the manually operated knob 41 and moving the valve member 39 from its normally closed position to its opened position as shown in FIG. 6. If the valve members 39 and 44 are connected together, as in the illustrated embodiment, the valve member 44 will be simultaneously moved to its closed position.

An operator may then readily raise the motor 11 by pivoting it upwardly about the pivot pin 19. Oil may freely flow from the chamber 29 through the bypass passage 37, open check valve 38 and open manual valve 39 to the chamber 31. Thus, the engine can be tilted up without any substantial restriction from the device 23.

Once the desired trim position is set, the operator need merely release the motor 11. Although the weight of the motor 11 tends to cause a rise in pressure in the chamber 31, the relief valve 36 is set to open at a pressure that is greater than the pressure generally by the mere weight of the motor 11. Hence, no flow from the chamber 31 to the chamber 29 may occur through the relief valve 36.

Since the check valve 47 is normally closed, liquid cannot be driven from the chamber 31 through the bypass line 45. Closure of the manually operated valve 44 also prevents any flow from the chamber 31 through the bypass line 42. Hence, the motor will be in effect locked up in its newly set trim position.

When the motor 11 is operating to drive the boat 12 forwardly in its shallow water condition, there is a thrust which occurs and which tends to increase the pressure in the chamber 31. However, the check valve 36 is set so as to resist normal slow speed running thrust and the motor 11 will not pivot downwardly. However, the motor can be caused to return to its normal running condition once the shallow water is left by increasing the speed of the motor 11 sufficiently so that the thrust causes the piston 28 to move downwardly and open the check valve 36. Therefore, the motor 11 may be returned to its normal condition once leaving the shallow water merely by accelerating it.

Considering again the condition when the motor 11 has been tilted up to a shallow water running condition, if the motor 11 is operated in a reverse mode, the unit 23 will tend to resist its pivoting upwardly. However, if a substantial backward thrust is experienced, the pressure in the chamber 29 will rise sufficiently so as to unseat the check valve 38 and permit reverse flow through the bypass passage 37 to the chamber 31 as shown by the solid lines in FIG. 6.

Application of forward thrust will, however, cause the motor 11 to again pivot downwardly through opening of the relief valve 36.

Figure 7:
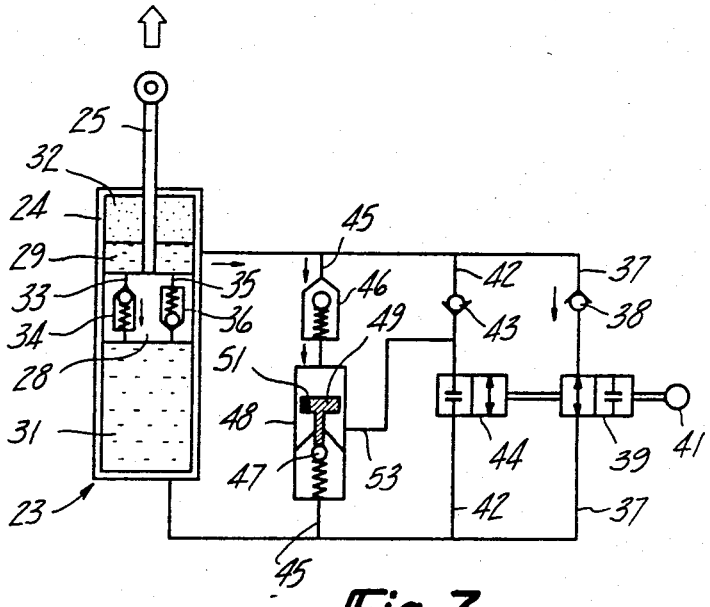
Figure 8:
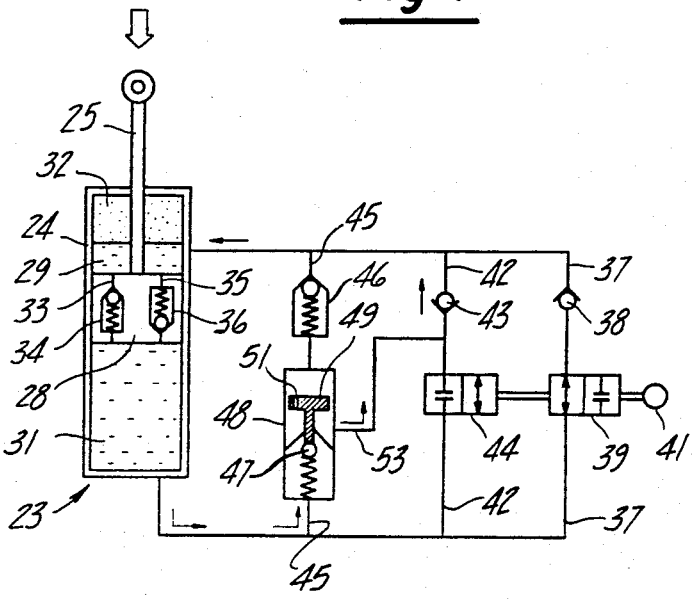

When operating in the shallow water condition, if the motor 11 strikes an obstacle when travelling forwardly, the motor can pop up since both the absorber valve 34 and check valve 47 can open under this condition. This condition is shown in FIG. 7. In addition, the check valve 38 will open and permit flow from the chamber 29 to the chamber 31. As aforedescribed, when the check valve 46 opens, the time delay piston 49 will effect opening of the check valve 47 so as to permit the motor to pop up. However, once the obstacle is passed, the weight of the motor acting on the piston 28 will cause the pressure in the chamber 31 to rise. Since the check valve 47 is held open by the time delay piston 49, fluid may flow from the chamber 31 through the passage 53 to open the check valve 43 and return to the chamber 29 (FIG. 8). Therefore, the motor 11 will gradually return to its normal running state.

In the illustrated embodiment, the manually operated valves 39 and 44 are operated in unison and are in opposite conditions. That is, when the valve 39 is closed, the valve 44 is opened and vice versa. It is to be understood, however, that the valves 39 and 44 can be operated independently and either could be in their opened or closed condition simultaneously. For example, if both valves 39 and 44 are closed at the same time, the device will still operate in substantially the same manner as aforedescribed.

Various other changes and modifications may be made without departing from the spirit and scope of the invention as defined by the appended claims.

I claim:

1. In a tilt locking and shock absorbing arrangement for a marine outboard trim comprising a drive member supported for tilting movement relative to a hull of an associated watercraft about a substantially horizontally disposed tilt axis, a hydraulic assembly comprising a cylinder and a piston slidably supported in said cylinder and dividing said cylinder into first and second chambers, means for operatively interposing said hydraulic assembly between said hull and said drive member for relative movment of said piston and said cylinder upon tilting movement of said drive member about said tilt axis, first passage means including pressure responsive absorber valve means for permitting flow from said first chamber to said second chamber upon the application of a predetermined force tending to cause said drive member to tilt up about said tilt axis, and second passage means including pressure responsive relief valve means for permitting flow from said second chamber to said first chamber upon the exertion of a predetermined force to effect tilt down of said drive member, the improvement comprising means for permitting said drive member to be tilted up about said tilt axis to a raised position and to be retained in said raised position comprising third passage means extending between said first and second chambers, first manually operated valve means for controlling the flow through said third passage means, and first check valve means in said third passage means for permitting flow from said first chamber to said second chamber when said first manually operated valve means is opened and for precluding flow from said second chamber to said first chamber through said third passage means when said first manually operated valve means is opened.

2. In a tilt locking and shock absorbing arrangement as set forth in claim 1 wherein the first passage means and the second passage means are formed in said piston and the pressure responsive absorber valve means and the pressure responsive relief valve means are carried by said piston.

3. In a tilt locking and shock absorbing arrangement as set forth in claim 2 wherein the pressure responsive relief valve means opens at a pressure greater than the pressure generated by the weight of the drive member for retaining the drive member in a tilted up position.

4. In a tilt locking and shock absorbing arrangement as set forth in claim 3 further including fourth passage means extending between the first and second chambers and having second manually operated valve means for controlling the flow through said fourth passage means and second check valve means in said fourth passage means for permmitting flow from said second chamber to said first chamber when said second manually operated valve means is opened and for precluding flow from said first to said second chamber through said fourth passage means when said second manually operated valve means is opened.

5. In a tilt locking and shock absorbing arrangement as set forth in claim 4 wherein the first manually operated valve means is a normally closed valve and the second manually operated valve is a normally opened valve.

6. In a tilt locking and shock absorbing arrangement as set forth in claim 5 wherein the manually operated valves are interconnected for simultaneous movement.

7. In a tilt locking and shock absorbing arrangement for a marine outboard trim comprising a drive member supported for tilting movement relative to a hull of an associated watercraft about a substantially horizontally disposed tilt axis, a hydraulic assembly comprising a cylinder and a piston slidably supported in said cylinder and dividing said cylinder into first and second chambers, means for operatively interposing said hydraulic assembly between said hull and said drive member for relative movement of said piston and said cylinder upon tilting movement of said drive member about said tilt axis, first passage means including pressure responsive absorber valve means for permitting flow from said first chamber to said second chamber upon the application of a predetermined force tending to cause said drive member to tilt up about said tilt axis, and second passage means including pressure responsive relief valve means for permitting flow from said second chamber to said first chamber upon the exertion of a predetermined force to effect tilt down of said drive member, the improvement comprising means for permitting popping up of the drive member about said tilt axis when the drive member strikes an obstacle comprising third passage means extending between said first chamber and said second chamber and including first check valve means for permitting flow from said first chamber to said second chamber, second check valve means downstream from said first check valve means permitting flow from said first chamber to said second chamber, time delay means for opening said second check valve means upon opening of said first check valve means and for holding said second check valve means opened for a time after said first check valve means closes, and fourth passage means including third check valve means for communicating said third passage means between said first and second check valve means and said first chamber, said third check valve means precluding flow through said fourth passage means from said first chamber and permitting flow through said fourth passage means to said first chamber.

8. In a tilt locking and shock absorbing arrangement as set forth in claim 7 wherein the first passage means and the second passage means are formed in said piston and the pressure responsive absorber valve means and the pressure responsive relief valve means are carried by said piston.

9. In a tilt locking and shock absorbing arrangement as set forth in claim 7 wherein the time delay means comprises a piston supported within a chamber and having a restricted orifice extending therethrough and carrying means for engaging the second check valve means for opening said second check valve means when a pressure is applied to one side of said piston and for resisting return movement of said piston and said second check valve means when the applied pressure is removed.

10. In a tilt locking and shock absorbing arrangement as set forth in claim 7 further including fifth passage means interconnecting the second chamber with the fourth passage means upstream of the third check valve means and first manually operated valve means for controlling the flow through said fifth passage means.

11. In a tilt locking and shock absorbing arrangement as set forth in claim 10 further including sixth passage means extending between the first chamber and the second chamber and having fourth check valve means for precluding flow from said second chamber to said first chamber and for permitting flow from said first chamber to said second chamber, and second manually operated valve means in said sixth passage means.

12. In a tilt locking and shock absorbing arrangement as set forth in claim 11 wherein the first manually operated valve means is normally opened and the second manually operated valve means is normally closed.

13. In a tilt locking and shock absorbing arrangement as set forth in claim 12 wherein the manually operated valve means are interconnecting for simultaneous movement between their opened and closed positions.

14. In a tilt locking and shock absorbing arrangement for a marine outboard drive comprising a drive member supported for tilting movement relative to a hull of an associated watercraft about a substantially horizontally disposed tilt axis, a hydraulic assembly comprising a cylinder and a piston slidably supported in said cylinder and dividing said cylinder into first and second chambers, means for operatively interposing said hydraulic assembly between said hull and said drive member for relative movement of said piston and said cylinder upon tilting movement of said drive member about said tilt axis, damping means for permitting flow from said first chamber to said second chamber upon the application of a predetermined force tending to cause said drive member to tilt up about said tilt axis, and for permitting flow from said second chamber to said first chamber upon the exertion of a predetermined force to effect tilt down of said drive member, the improvement comprising means for permitting popping up of said drive member about said tilt axis when the drive member strikes an obstacle comprising first passage means extending between said first chamber and said second chamber and including first check valve means for permittiing flow from said first chamber to said second chamber, second check valve means downstream from said first check valve means permitting flow from said first chamber to said second chamber, time delay means for opening said second check valve means upon opening of said first check valve means and for holding said second check valve means opened for a period of time after said first check valve means closes, and second passage means including third check valve means for communicating said first passage means between said first and second check valve means with said first chamber, said third check valve means precluding flow through said second passage means from said first chamber and permitting flow through said second passage means to said first chamber.

* * * * *